US005378205A

United States Patent [19]

Gohl et al.

[11] Patent Number: 5,378,205

[45] Date of Patent: Jan. 3, 1995

[54] EXTRUDED METAL CHAIN PIN

[76] Inventors: Allen P. Gohl, 4501 Singh, Sterling Heights, Mich. 48310; Edmund W. Gohl, 304 Coldiron, Rochester Hills, Mich. 48063-5873

[21] Appl. No.: 132,114

[22] Filed: Oct. 5, 1993

Related U.S. Application Data

[62] Division of Ser. No. 925,508, Aug. 5, 1992.

[51] Int. Cl.[6] ..... F16G 15/00

[52] U.S. Cl. ..... 474/206; 474/212

[58] Field of Search ..... 474/206–217, 474/226

[56] References Cited

U.S. PATENT DOCUMENTS 4,610,647 9/1986 Weeds ..... 474/206

4,704,098 11/1987 Tsubakimoto ..... 474/206

4,983,147 1/1991 Wu ..... 474/212 X 5,178,585 1/1993 Lin et al. ..... 474/212 X

*Primary Examiner*—Michael Powell Buiz

*Attorney, Agent, or Firm*—Reising, Ethington, Barnard, Perry & Milton

[57] ABSTRACT

An extruded metal chain pin (34) for connecting center and side links of a chain together. The chain pin (34) comprises an extruded solid cylindrical body (130), having two flattened transverse ends (132) and an extruded grain structure (134) extending parallel through the length of the cylindrical body (130). The pin is characterized by all of the extruded grain structures (134) extending parallel to the cylindrical body (130) and into the flattened transverse ends (132) before reaching flare-out points.

3 Claims, 7 Drawing Sheets

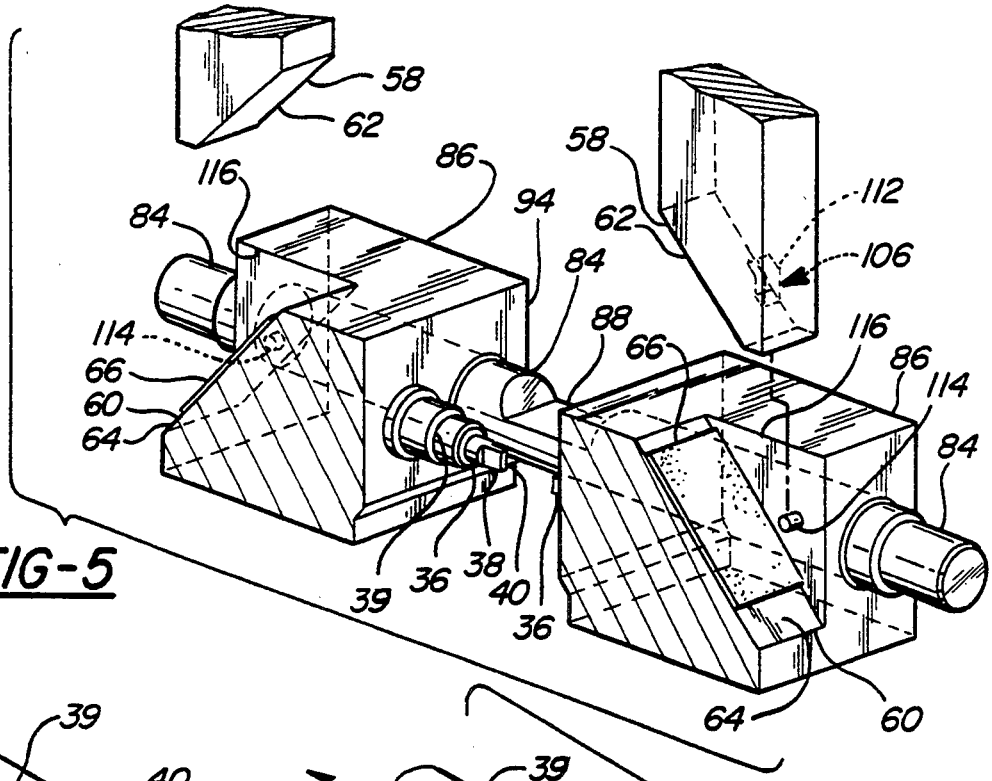
FIG-5
FIG-7
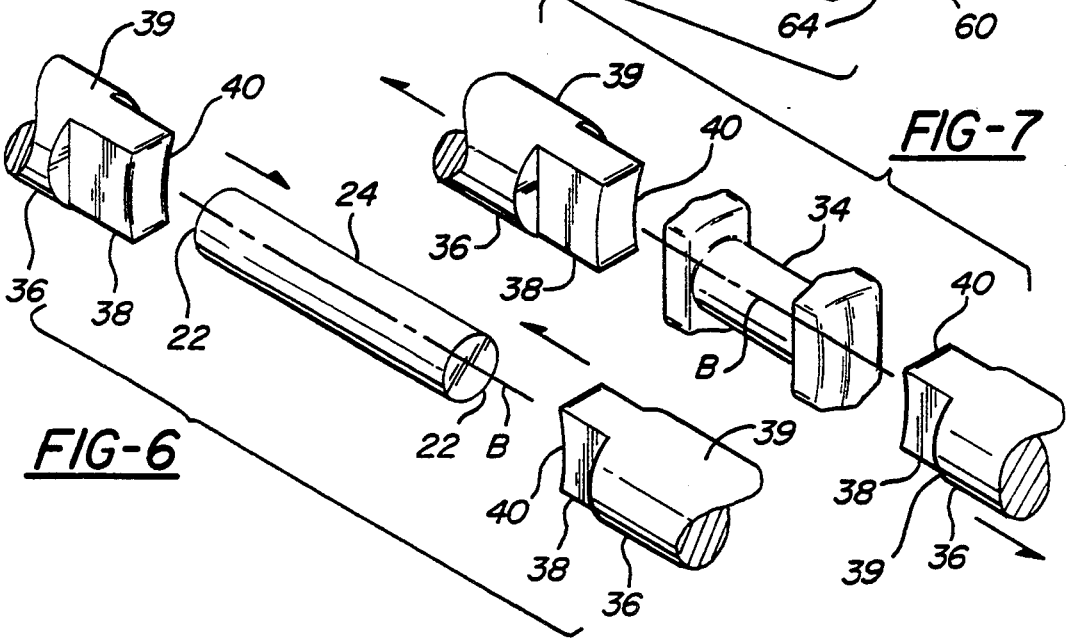
FIG-6
FIG-8
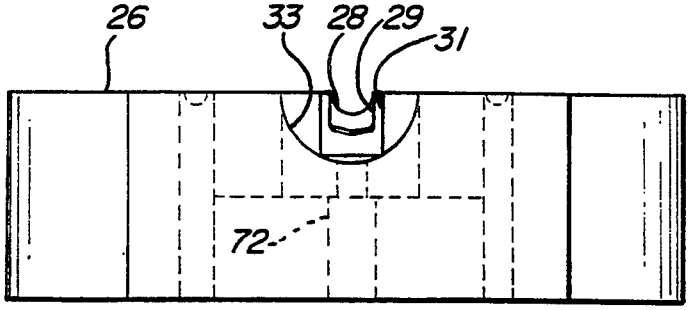

EXTRUDED METAL CHAIN PIN

This is a division of application Ser. No. 07/925,508 filed Aug. 5, 1992.

BACKGROUND OF THE INVENTION

1. Technical Field

The subject invention relates to the apparatus and method for manufacturing chain pins. More particularly, the subject invention relates to the method and apparatus for upsetting the ends of a solid cylindrical blank to create a chain pin.

2. Description of Related Art

Precision is required when upsetting the ends of solid cylindrical blanks when manufacturing chain pins. The chain pins rotatably interconnect the center links to the side links. Therefore, the smoother the surface of pins, the less wear in the rotational movement of the chain links about or relative to the chain pins. The greater precision in the forming of the pins, the smoother the wear surfaces.

U.S. Pat. No. 2,755,545 to Moore, issued Jul. 24, 1956 discloses an apparatus for forming blanks from ingots of metal. Two hydraulic cylinders on either side of the metal working cavity press the metal into shape of the cavity. This system of pressing metal is not of sufficient precision because two separate hydraulic cylinders are used at either end of the cavity, but are independent and will form non-uniform results if the hydraulic cylinders are not working properly.

U.S. Pat. No. 4,693,107 to Kohama et al., issued Sep. 15, 1987 discloses a method for forming wound bush bearings. The exterior of a bearing is clamped by use of two pairs of tapered surfaces. A mandrel located between the tapered surfaces presses the bush bearing forming a flange after the tapered surfaces have clamped the material in place. This assembly cannot, however, simultaneously work both ends of the bearing because the working force operates in the same direction as the ram, i.e., the direction of movement of the ram and the force are both in the vertically downward direction.

U.S. Pat. No. 3,588,933 to Shinopulos et al. discloses an apparatus for simultaneously upset forming two ends of a blank. This system, however, is silent as to initiating the movement simultaneously.

SUMMARY OF THE INVENTION AND ADVANTAGES

A press assembly for upsetting the ends of a cylindrical blank is disclosed. The assembly comprises lower die means for positioning a cylindrical blank. The cylindrical blank includes two ends and a longitudinal axis extending therebetween. The lower die means includes a recess which defines a horizontal axis and a plurality of lower recess edges. Upper die means secures the cylindrical blank in the lower die recess with the longitudinal axis of the cylindrical blank disposed adjacent to and parallel with the horizontal axis. Punch means disposed along the horizontal axis on either side of the recess is slidable between a retracted position outside the lower die recess and an extended position within the lower die recess. The punch means move axially and inwardly along the horizontal axis into the lower die recess to upset the two ends of the cylindrical blank. The assembly is characterized by actuating means for vertically moving the upper die means downwardly into clamping relationship with the lower die means. The actuating means maintains the clamping relationship during the continued downward vertical movement of the actuating means for moving the punch means from the retracted position into the lower die recess. The punch means moves axially and inwardly along the horizontal axis and upset each of the two ends of the cylindrical blank.

The advantages of the subject invention include, but are not limited to, the ability to mass produce chain pins that are stronger and more uniform in appearance. Additionally, the bodies of the chain pins are produced without flash.

FIGURES IN THE DRAWINGS

Other advantages of the present invention will be readily appreciated as the same becomes better understood by reference to the following detailed description when considered in connection with the accompanying drawings wherein:

FIG. 5 is an exploded perspective view in cross section of the upper and lower wedges of the preferred embodiment of the subject invention;

FIG. 6 is an exploded perspective view of the punches, partially cut away, prior to upsetting the ends of a cylindrical blank;

FIG. 7 is an exploded perspective view of the punches, partially cut away, after upsetting the ends of a cylindrical blank;

FIG. 8 is a side view of the preferred embodiment of the lower die;

DETAILED DESCRIPTION OF THE DRAWINGS

The Assembly

Figure 1:
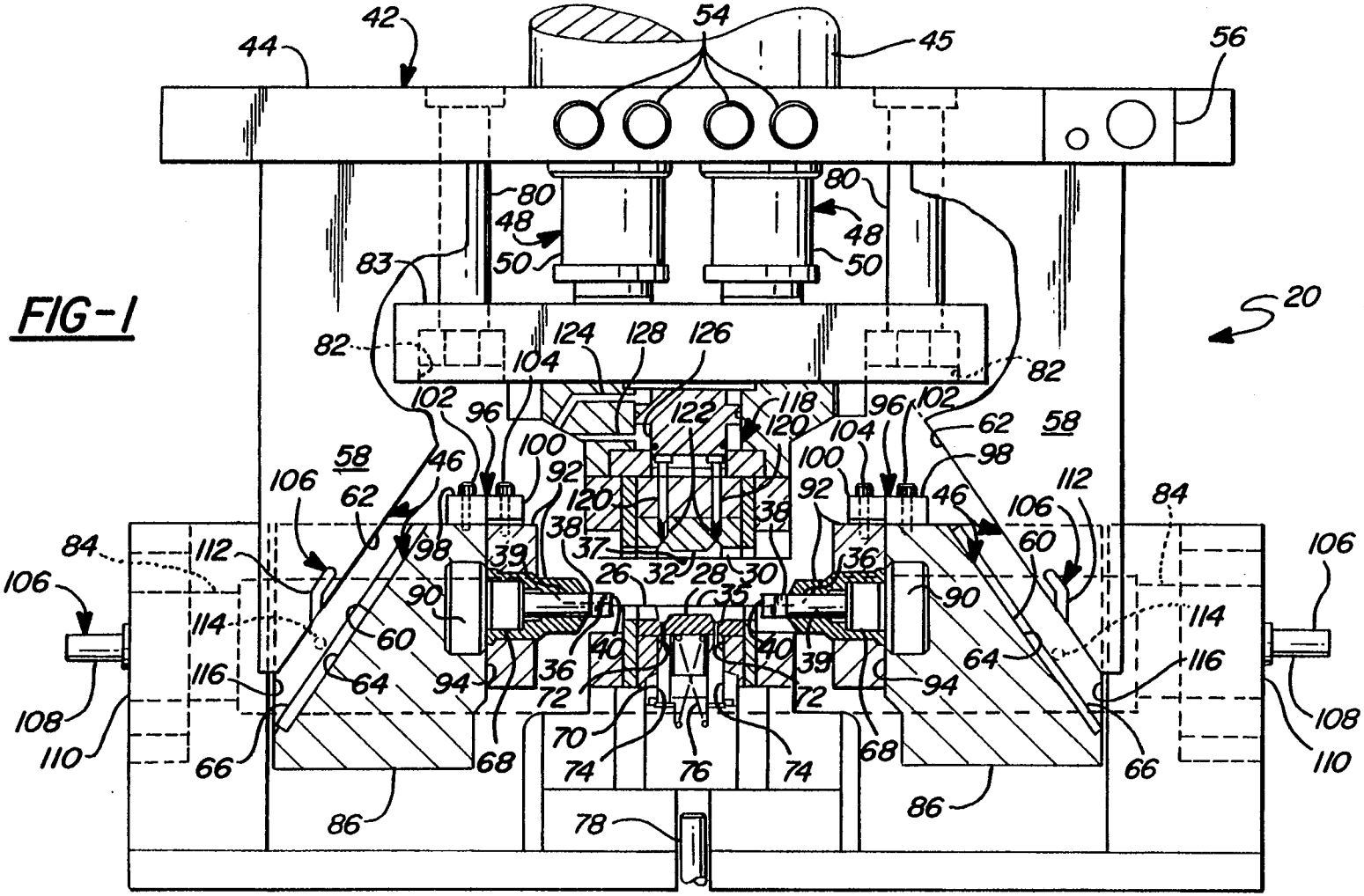
FIG. 1 is a side view of the preferred embodiment of the subject invention partially cut away and in partial cross section with the upper die in the retracted position.

Turning to FIGS. 1–8, the subject assembly, generally shown at 20, is a punch press. The punch press 20 punches the ends 22 of a cylindrical blank 24 (best seen in FIG. 6). The punch press 20 includes lower die means 26 for positioning the cylindrical blank 24. The lower die means 26 includes a lower die recess 28 defining a horizontal axis A.

The cylindrical blank 24, is placed in the lower die recess 28 such that the longitudinal axis B defining the cylindrical blank 24 is disposed adjacent to and parallel with and the horizontal axis A. More specifically, the cylindrical blank 24 has a radius C which is smaller than the radius R of the lower die recess 28 preventing the longitudinal axis B and the horizontal axis A from being coaxial. Said another way, the cylindrical blank 24 is necessarily smaller in diameter than the lower 28 and upper 32 (discussed subsequently) die recesses.

The punch press 20 further includes upper die means 30 for securing the cylindrical blank 24 in the lower die recess 28 concentric with the horizontal axis A. In the preferred embodiment, the upper die means 30 includes an upper die recess 32 which is a mirror image of the lower die recess 28 so the resulting chain pin 34 (discussed subsequently) will be symmetrical about its longitudinal axis B.

As may be best seen in FIG. 8, the lower die means, or lower die, 26 includes the lower die recess 28. When the ends 22 of the cylindrical blank 24 are upset or formed, the material flows into a receiving portion 29 of both the lower 28 and upper 32 die recesses. A punch seat 31 receives the end 38 of the punch 36 therein. The cylindrical portions 37 of the punches 36 slide in the semi-circle 33. In the preferred embodiment, an upper die means 30 is a mirror image of the lower die 26.

The enlarged receiving portions 29 include backing means 41 for forming the two ends 22 of the cylindrical blank 24 as the two ends 22 are being upset by the two punches 36. The backing means 41 provides support for the forming material during the upset process. More specifically, the backing means includes a back face 41 at each of the enlarged receiving portions 29 to exert a force on the two ends 22 as the two ends 22 are flowing into the enlarged receiving portions 29. Said another way, the back face 41 supplies a force 43 opposite in direction to the force 51 created by the movement of the two punches 36 as they upset the two ends 22. The combination of the force 43 supplied by the back faces 41 and the clamping force 47 equals the force 51 exerted thereon by the two punches 36.

The force 43 exerted by each of the back faces 41 occurs after the punches 36 have made contact with the two ends 22 and have expanded the center of the cylindrical blank 24 to the diameter of the recess defined by the lower 26 and upper 32 recesses. The cylindrical blank 24 immediately expands in diameter to fill the upper 32 and lower 28 die recesses (approximately 1/1000″-2/1000″) as it absorbs the impact of the two punches 36 hitting each end 22 of the cylindrical blank 24 simultaneously. After the cylindrical blank 24 has expanded radially, the clamping relationship between the upper 30 and lower 26 die means prevents any additional radial expansion. The two ends 22 begin to flow outwardly into the enlarged receiving portions 29 in response to the continued inward direction of the two punches 36. The back face 41 restricts the continued movement of the flowing material and counters the forces 51 of the two punches 36. Hence, the vertically downwardly directed clamping force 47 is not required to be greater than the inwardly directed force 51 of the two punches 36 because the difference between the forces is eliminated by the force 43 of the back face 41.

The clamping force 49 fully closes the upper die means 30 onto the lower die means 26 which prevents the production of flash along the sides of the chain pin 34. In other words, the ability to have all of the plurality of lower recess edges 35 of the lower die means 26 positively contact to all of the plurality of upper recess edges 37 of the upper die means 30 prevents any material to flow therebetween as the two ends 22 of the cylindrical blank 24 are upset or formed.

The lower die recess 28 and the upper die recess 32 each define a plurality of edges 35,37, respectively, wherein the plurality of edges 35 of the lower die recess 28 must align or match the plurality of recess edges 35 of the upper die recess 32. The alignment thereof prevents the production of any lines or flash which would create a chain pin 34 which not smoothly interact with the parts it is retaining. Any offset X which may occur does not exceed one-one thousandths of an inch (1/1000″).

Figure 3:
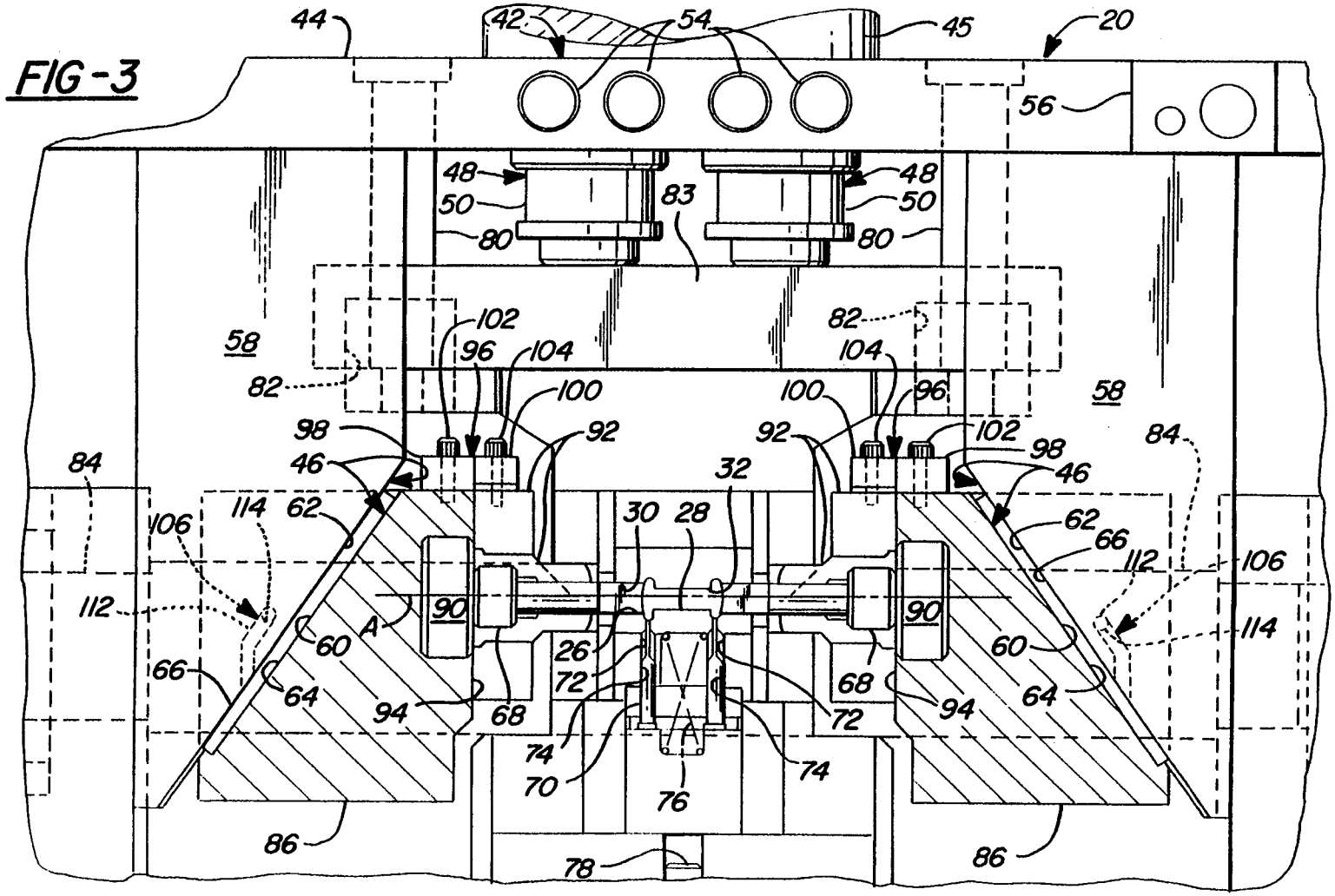
FIG. 3 is a side view of the preferred embodiment of the subject invention in partial cross section when the actuating means completes the downward stroke.
Figure 4:
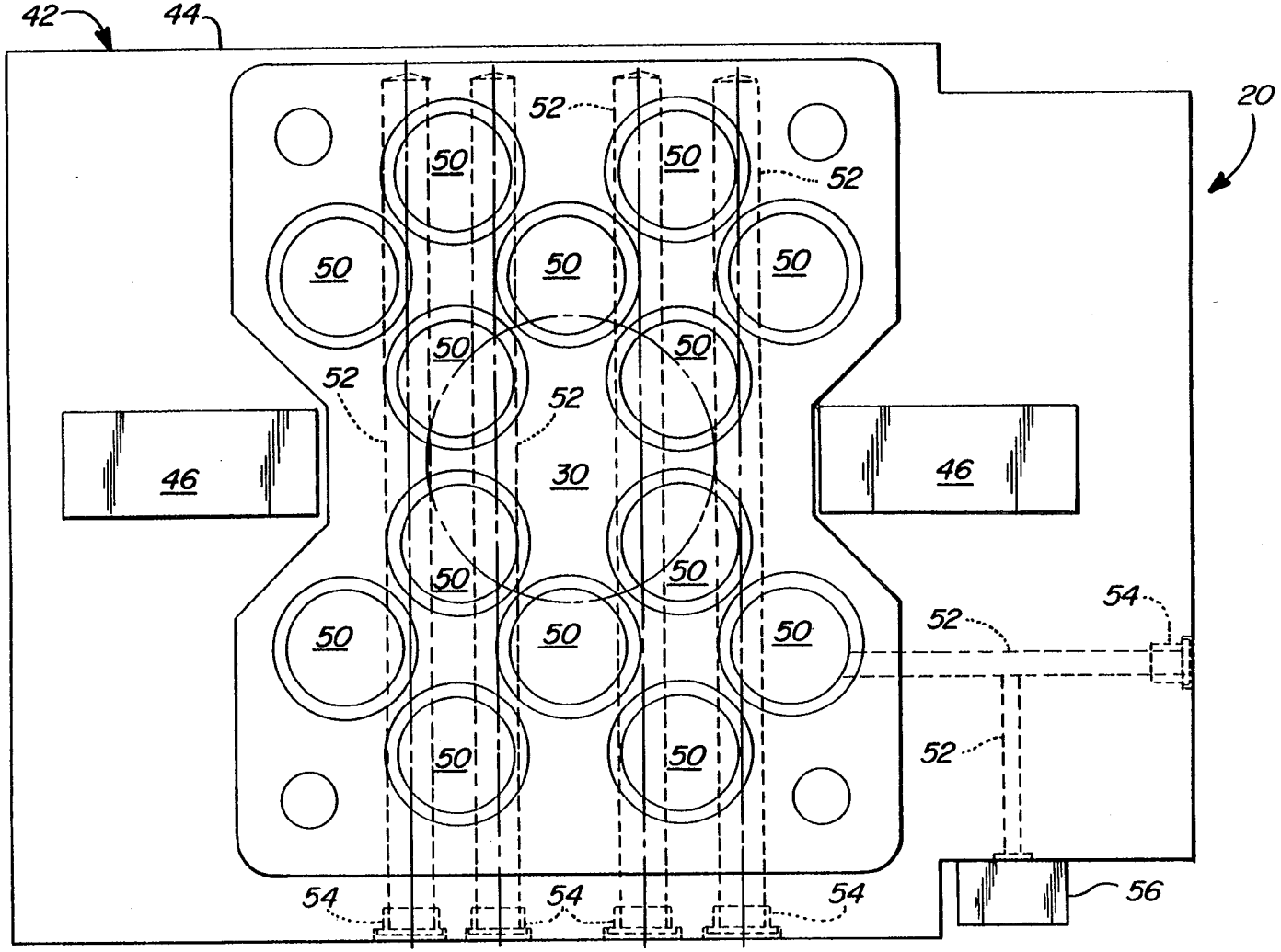
FIG. 4 is a top view of the preferred embodiment of the subject invention.

Punch means 36 is disposed along the horizontal axis A on either side of the recess 28 and is slidable between a retracted position outside of the lower die recess 28 (as shown in FIG. 1) and an extended position within the lower die recess 28 (as shown in FIG. 3). The punch means 36 includes two punches 36 on either side of the lower die means 26 and are coaxial with the horizontal axis A. The ends 38 of the two punches 36 are rectangular in cross section and have concave end surfaces 40 which aids in the directing of the flow of the ends 22 as they are being upset or punched by the two punches 36.

Actuating means, generally indicated at 42, vertically moves or lowers the upper die means 30 onto the lower die means 26 and clamps the upper die means 30 thereto. The actuating means 42 also creates an upset force directed vertically downwardly toward the lower die means 26 while maintaining the clamping relationship between the upper 30 and lower 26 die means. The actuating means 42 further includes a plate 44.

The actuating means 42 divides the upset force into two halves. Said another way, the actuating means 42 splits into two the overall upset force created by a mechanical crank, represented by a rod 45. The two halves of the portion of the upset force are used to move the two punches 36 axially and inwardly into the lower die recess 28 along the horizontal axis A. As an example, the range of upset forces used to move the two punches 36 to upset the ends 22 of the size of cylindrical blank 24 used is approximately between 200 tons and 300 tons, approximately one-half to three quarters of the maximum total upset force of 400 tons.

The actuating means 42 clamps the upper die means 30 to the lower die means 26 after the upper die means 30 contacts the lower die means 26 and maintains this clamping relationship while the two punches 36 are moving inwardly due to the continued downward motion of the actuating means 42. The actuating means 42 utilizes approximately 100–200 tons of force to clamp the upper die 30 to the lower die 26. By way of example only, a cylindrical blank 24 having a diameter of $\frac{5}{8}$″ requires a clamping force of 80 tons.

The actuating means 42 includes a plurality of shock absorbers 48 for providing lost motion between the actuating means 42 and the upper die means 30 after the upper die means 30 has come into clamping engagement with the lower die recess 26. In other words, the plurality of shock absorbers 48 maintains the clamping engagement of the upper die means 30 to the lower die means 26 while the actuating means 42 continues its downward movement. The shock absorbers 48 may be any elastic device which deforms as it absorbs energy and subsequently returns to its original shape after the force has been relieved therefrom. In the preferred embodiment of the subject invention 20, the plurality of shock absorbers 48 comprise a plurality of pneumatic shock absorbers 48 with sealed telescoping elements 50 which are filled with nitrogen. The nitrogen is supplied through a flowpath 52 which may best be seen in phantom in FIG. 4. The flowpath 52 is drilled through the plate 44 so the shock absorbers 48 may be fixedly secured directly to the plate 44. The flowpaths 52 are sealed using a plurality of caps 54.

The amount of nitrogen within the system 48,52 is measured by a meter 56 schematically shown in FIGS. 1–4. Any type of meter 56 may be used which will accurately measure the amount of nitrogen pressure within the system 48,52.

The actuating means 42 further includes wedging means 46 for interconnecting the actuating means 42 and the two punches 36 to move the two punches 36 from the retracted position into the lower die recess 28. The wedging means 46 include two upper wedges 58 and two lower wedges 60. Each of the upper wedges 58 are fixedly secured to the plate 44 and extend down toward the upper die 30. The wedge surfaces 62 of the upper wedges 58 extend away from the upper die 30. Each of the upper wedges 58 are on opposite sides of the upper die 30.

Each of the lower wedges 60 are also on either side of the lower die 26. The lower wedges 60 include lower wedge surfaces 64 which complement the upper wedge surfaces 62. In other words, from a reference point above the press assembly 20, the lower wedge surfaces 64 extend out and away from the lower die 26 the same angle at which the upper wedge surface 62 extend out and away from the upper die 30.

The two upper wedges 58 and the two lower wedges 60 coact with each other to convert the downward vertical movement of the actuating means 42 into a horizontally and inwardly directed upset force directed along the horizontal axis A toward the lower die recess 28. The horizontally and inwardly directed upset force moves the two punches 36 inwardly from their retracted position into the lower die recess 28.

Wear means 66 located between the upper 62 and the lower 64 wedge surface prevent wear due to friction created by relative motion between the upper 58 and lower 60 wedges. The wear means 66 are wear pads made of a soft metal, i.e., bronze, which are removably secured to the lower wedge surfaces 64. After sufficient wear has reduced the thickness of the wear pads 66, the wear pads 66 are replaced.

The punch press 20 further includes spacing means 68 having a predetermined thickness for spacing the punches 36 from the recess 28. The spacing means 68 are removably secured to lower wedges 60 so they may be interchanged with spacing means or pads 68 of different thicknesses. The spacing pads 68 are made from billets of metal ground down to a precise thickness. The thickness of the spacing pads 68 depends on the size of the chain pin 34 being produced. Smaller chain pins 34 require spacing pads 68 of greater thickness which allows the punches 36 to reach the smaller cylindrical blanks 24. Conversely, thinner spacing pads 68 are required when manufacturing larger chain pins 34.

Ejecting means 70 disposed with the lower die 26 ejects the newly formed chain pin 34 (previously the cylindrical blank 24) out of the lower die 26. The lower die 26 includes at least one hole 72 to allow the ejecting means 70 to pass through the lower die 26. A pin 74 extends through the hole 72 and forces the chain pin 34 out of the lower die 26. (A subsystem not a part of the subject punch press 20 collects the chain pins 34 and stores theses parts in a storage container suitable for storage and/or shipment.)

In the preferred embodiment, the ejecting means 70 includes two pins 74 wherein each of the two pins 74 extend through a separate hole 72 which extend through the lower die 26 perpendicularly to the horizontal axis A.

The two ejecting pins 74 are springbiased down out of the lower die recess 28 via a spring 76. The spring 76 exerts a force on the ejecting pins 74 in a direction away from the lower die recess 28 and parallel to the holes 72. A rod 78, located below the spring 76, forces the pins 74 up and out through the holes 72 into the lower die recess 28. The rod 78 is connected to a piston (not shown) which forces the rod 78 to move in a direction against the force created by the spring 74.

Lost motion guiding means 80 guides the actuating means 42 toward the upper die 30 as the shock absorbers 48 collapse due to the downwardly directed forces 47 exerted thereon by the mechanical crank 45. The lost motion guiding means 80 includes a plurality of rods, four in the preferred embodiment, each of which extends through the plate 44. A mounting plate 83, fixedly secured to the upper die 30, includes four lost motion areas 82 which provides for lost motion between the plate 44 and the upper die 30.

Wedge guiding means 84 guides the lower wedges 60 in a horizontal direction, parallel with the horizontal axis A. The wedge guiding means 84 includes at least one tie rod 84 extending the width of the punch press 20. Because the actuating means 42 used to produce the upset force is so massive, two tie rods 84 (only one shown) are needed wherein each tie rod 84 is on either side of the lower wedges 60. More particularly, two blocks 86, each having one of the lower wedges 60 disposed in the center thereof, have the two tie rods 84 extending therethrough on either side of the lower wedges 60.

The two tie rods 84 include a flat 88 halfway between the ends of each of the two tie rods 84. Because the two tie rods 84 are acting as a guiding system for a great amount of weight moving due to a large force, the tie rods 84 must be substantial, i.e., thick, to prevent jerky movement of the two punches 36. To enhance smooth movement and optimal stability of the two punches 36, the centers of the tie rods 84 define a single plane with the horizontal axis A. In other words, the centers of the tie rods 84 and the horizontal axis A form a single horizontal plane and are all parallel to each other within that horizontal plane. Two flats 88, each formed in each of the two tie rods 84, provide the space necessary for the automation needed to insert cylindrical blank 24 into the recess 28 and remove the resulting chain pins 34 therefrom. If the flats 88 did not exist, automation would not be possible.

Pressure reducing means 90, located between the spacing pads 68 and the blocks 86, absorb the force when the punches 36 upset the ends 22 of the cylindrical blank 24. The pressure reducing means 90 have a larger diameter than the punches 36 or the spacing pads 68 which reduces the force per unit area hitting the blocks 86. The pressure reducing means or wear pads 90 are a cost effective measure which reduce the wear and tear on the blocks 86 by reducing the pressure produced by upsetting the ends 22 by spreading it over a greater area. Additionally, replacing the wear pads 90 is a more inexpensive measure compared with the replacement of the blocks 86.

Securing means 92 removably secures the two wear pads 90 and the two spacing pads 68 to each of the lower wedges 60. More particularly, the securing means 92 are securable to the side 94 of each block 86 opposite the lower wedges 60. The securing means 92 are collars which surround the spacing pads 68 and the punches 36 and are removably secured to the flat sides 94 of the blocks 86 facing the lower die 26.

Vertical adjustment means, generally indicated at 96, adjusts the vertical position of the punches 36. The vertical adjustment means 96 includes a base 98, an extension 100 and two bolts 102,104. The base 98 is secured to the block 86 via the first bolt 102. The extension 100 is fixedly secured to the base 98 and extends over the collar 92. The second bolt 104 extends through the extension 100 and extends into the collar 92. Rotation of the second bolt 104 moves the collar 92 vertically up or down. The vertical adjustment of the punches 36 is required for precision alignment of the punches 36 with respect to the lower die 26 and the upper die 30.

Returning means, generally indicated at 106, move the lower wedges 60 away from the lower die 26 when the punch press 20 begins the return cycle of the press cycle. Said another way, the returning means 106 moves the lower wedges 60 away from the lower die 26 as the upper wedges 58 begin to move up and away from the lower die 26.

The returning means 106 includes a plurality of pneumatic cylinders 108 fixedly secured to the ends 110 of the tie rods 84. The pneumatic cylinders 108 include rods (not shown) which are fixedly secured to the blocks 86. These rods telescope into the pneumatic cylinders 108 when the pneumatic cylinders 108 are activated. Any pneumatic cylinder known in the art capable of handling the load requirements for the punch press 20 may be used.

The returning means 106 further includes, as a backup system, a plurality of slotted cams 112 and followers 114. The slotted cams 112 are cut out of either side of the upper wedges 58 and the followers are secured to the walls 116 of the blocks 86 which are disposed adjacent the lower wedges 60. The slotted cams 112 have two sides wherein one side opens at the face of the upper wedge 58 to receive the follower 114 therein. The second side of the slotted cam 112 extends from the first side up into the upper wedges 58 parallel to the upper wedge 58. Therefore, an obtuse angle is created between the two sides of each of the slotted cams 112.

Figure 2:
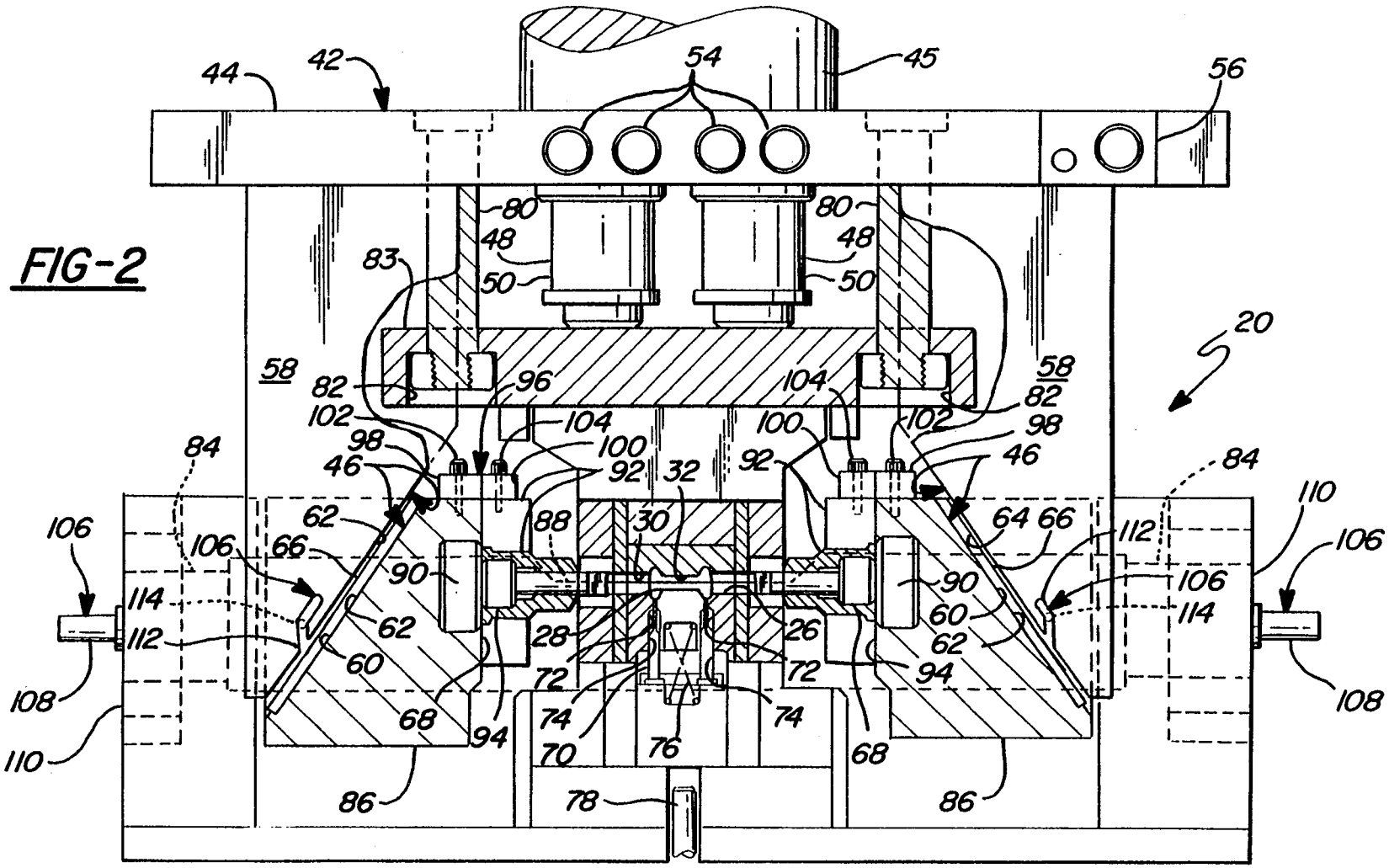
FIG. 2 is a side view of the preferred embodiment of the subject invention partially cut away and in partial cross section with the upper die in the extended position.

As may be seen by viewing FIGS. 1-3, the progression of the stroke of the punch press 20 shows the relationship between the slotted cam 112 and the follower 114. In FIG. 1, the followers 114 is below the slotted cams 112. When the upper die 30 contacts the lower die 26, the followers 114 are at the end of the first side of the slotted cam 112. And at the end of the down stroke, the followers 114 are at the ends of the second sides of the slotted cams 112. In order for the upper wedges 58 to move up during the return stroke, the upper wedges 58 must move the lower wedges 60 back away from the lower 26.

Upper ejecting means, generally indicated at 118, ejects the cylindrical blank out of the upper die 30 after the ends 22 of the cylindrical blank 24 have been upset, i.e., when the chain pin 34 has been produced. The upper ejecting means 118 includes two pins 120 which extend down through two holes 122 in the upper die 30. The two pins 120 are forced down through the two holes 122 when fluid, typically air, is fed through inlet line 124 into an upper ejecting air chamber 126. When the chain pin 34 is ejected from the upper die 30 the air within the upper ejecting air chamber 126 is released through the outlet line 128. The upper ejector 118 insures the chain pin 34 is not jammed into the upper die 30 which will result in the misfeed of the punch press 20 and, hence, downtime.

Method of Fabrication

The method for upsetting the ends 22 of a cylindrical blank 24 to fabricate a chain pin 34 comprise the steps of placing the cylindrical blank 24 in the lower die recess 28 of the lower die 26. The upper die 30 is lowered by the mechanical crank 45. The mechanical crank 45 creates a downwardly directed force and clamps the upper die 30 to the lower die 26 securing the cylindrical blank 24 in the lower die recess 28 with the ends 22 of the cylindrical blank 24 extending axially along a longitudinal axis B which is disposed adjacent to and parallel with the horizontal axis A of the lower die recess 28. The downwardly directed movement of the mechanical crank 45 is continued to produce an inwardly directed force which forces the punches 36 horizontally into the lower die recess 28 while the clamping engagement of the upper 30 and lower 26 dies is maintained. The force upsets the ends 22 of the cylindrical blank 24. In alternative embodiments, the mechanical crank 45 may be substituted with a hydraulic ram or a screw operated press. This list of alternatives is in no way exhaustive.

The force used to move the punches 36 horizontally was created by the transforming the downwardly directed force horizontally by use of the interaction between the upper 30 and lower 26 wedges.

The method includes the step of contacting all of the plurality of upper recess edges 37 to all of the plurality of lower recess edges 35. The contact is positive and the subsequent clamping occurs continuously along the lengths of each of the plurality of matching upper 37 and lower 35 recess edges. This prevents flash from being produced along the chain pin 34.

The two ends 22 of the cylindrical blank 24 are simultaneously upset. Subsequently, the upper die 30 is removed and the cylindrical blank is ejected from both the upper 30 and lower 26 dies.

The Chain Pin

Figure 9:
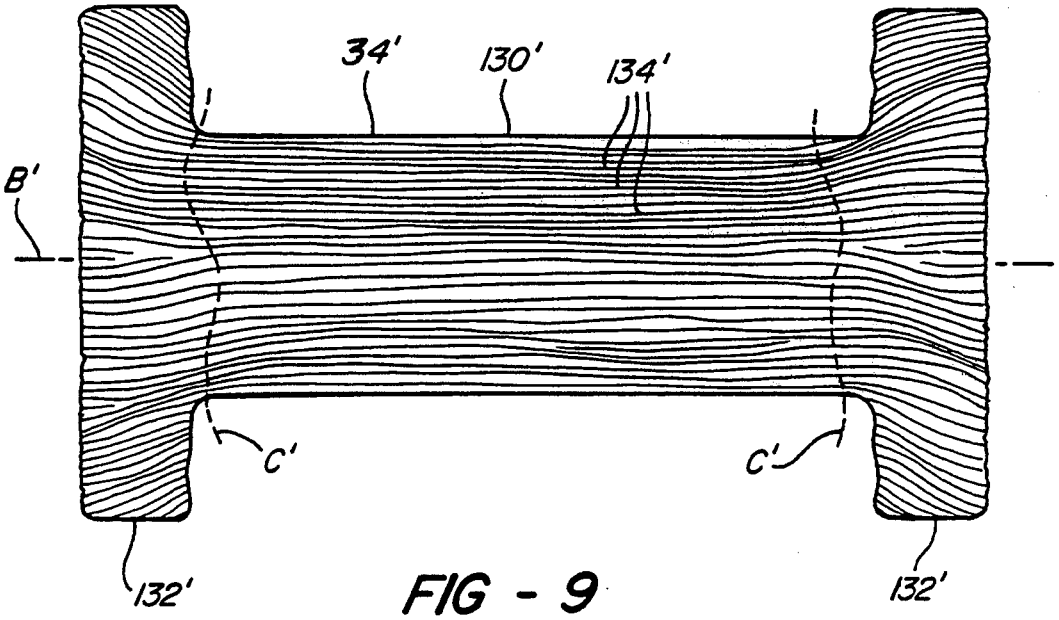
FIG - 9 PRIOR ART
FIG. 9 is a cross-sectional view of a chain pin having upset ends formed by the methods of the prior art.
Figure 10:
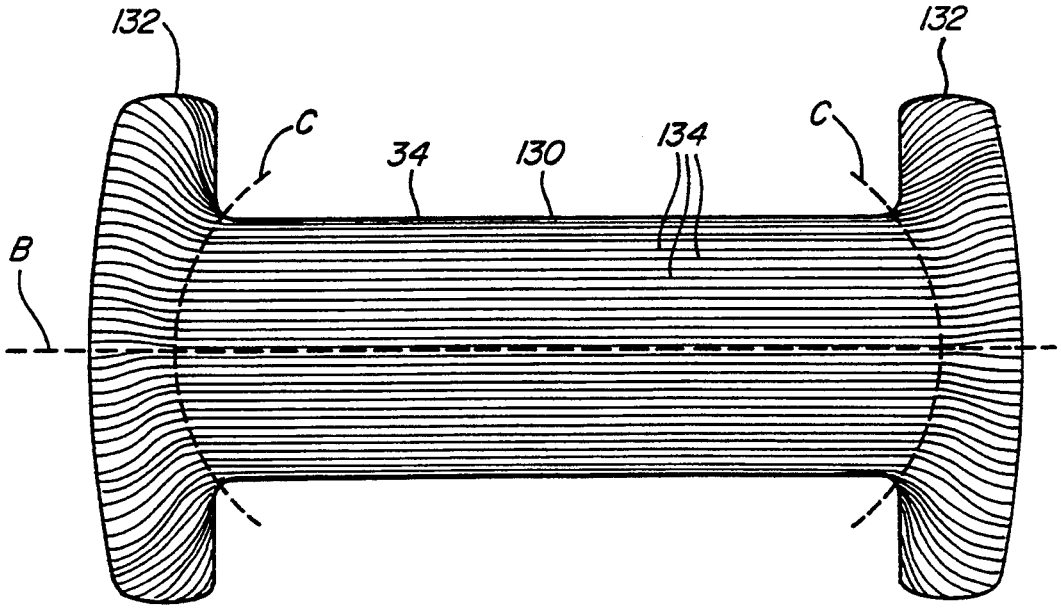
FIG. 10 is a cross-sectional view of the preferred embodiment of the subject chain pin using the subject method.
Figure 11:
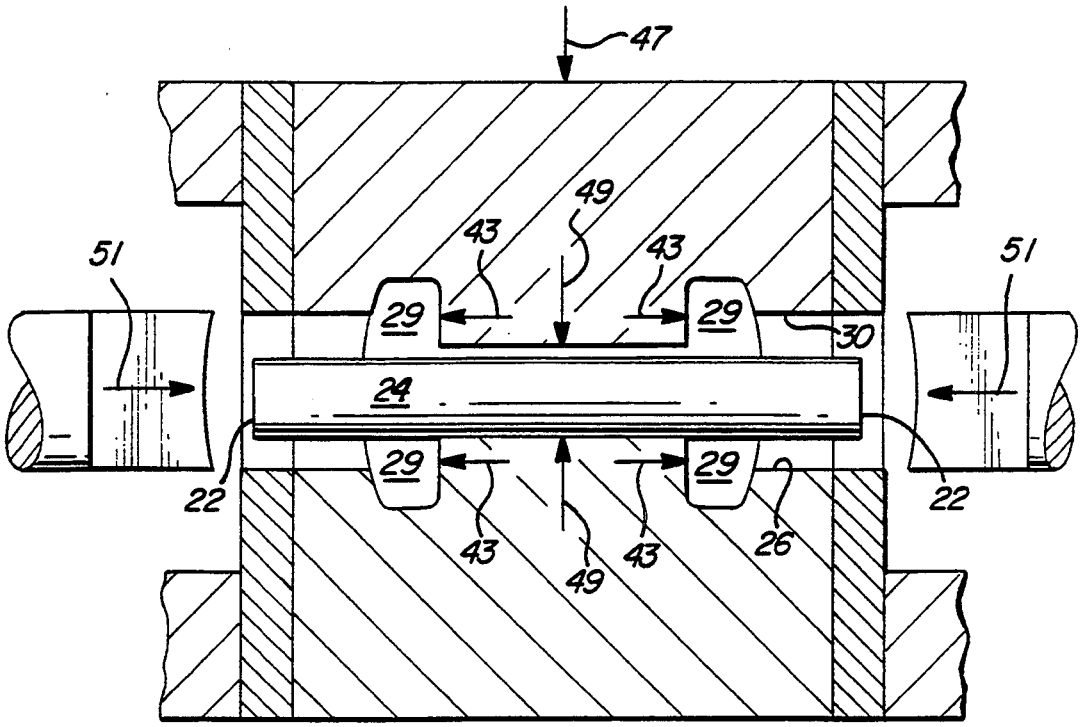
FIG. 11 is a cross-sectional side view of the upper and lower dies with a cylindrical blank disposed therein.
Figure 12:
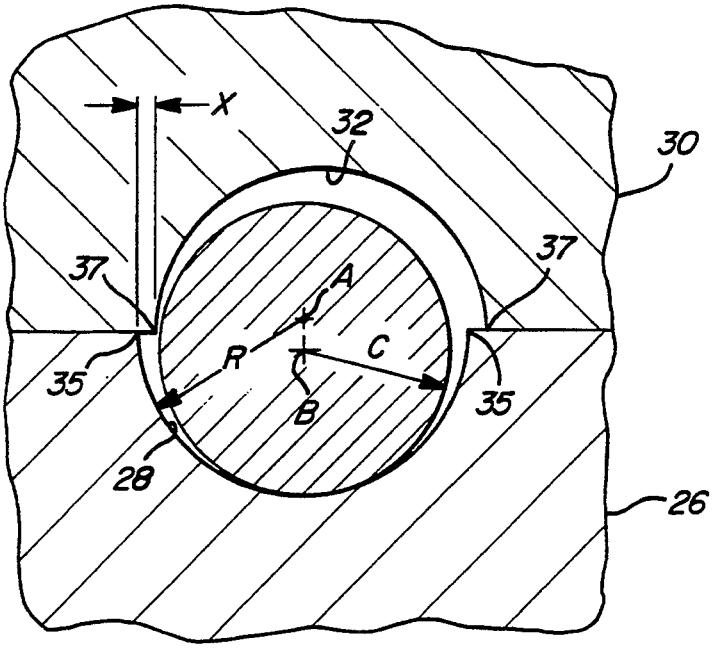
FIG. 12 is a cross-sectional end view of the upper and lower dies with a cylindrical blank disposed therein.

The chain pin 34, as may be best seen in FIG. 10, used to connect the center and side links of a chain (not shown) together comprises an extruded solid cylindrical body 130. (Primed numerals in FIG. 9 represent similar parts of chain pins in the prior art.) The cylindrical body 130 has a predetermined diameter and a longitudinal axis B extending therethrough. The cylindrical body 130 has two ends 132 and a parallel extruded grain structure 134 extending parallel to the longitudinal axis B therebetween.

The two ends 132 of the chain pin 34 are flattened transverse ends 132 and have a length greater than the predetermined diameter of the cylindrical body 130. The extruded grain structure 134 disperses throughout the flattened transverse ends 132. More specifically, the extruded grain structure 134 defines flare-out points such that the extruded grain structure 134 flares out throughout the flattened transverse ends 132 at the flare-out points.

The extruded metal chain pin 34 is characterized by all of the extruded grain structure 134 extending parallelly into the flattened transverse ends 132. Said another way, all of the parallel grain structure 134 extends beyond a plane D defined by the inner side surface of the flattened transverse ends 132 before the extruded grain structure 134 reaches the flare-out points. The extruded grain structure 134' of the prior art forged chain pin 34' disperses well within the cylindrical body 130'.

The extruded metal chain pin 34 is further characterized by the extruded grain structure 134 dispersing in two substantially convex subsurfaces 136 with the flattened transverse ends 132. More specifically, the flare-out points of the extruded grain structure defines an imaginary convex surface (C) at each of the two flattened transverse ends 132. Additionally, the extruded metal chain pin 34 is further defined by the flattened transverse ends 132 having a substantially rectangular cross section.

The flattened transverse ends 132 are created simultaneously when the punches 36 are forced horizontally inwardly into the lower die recess 28. The concave ends 40 of the punches 36 create a rounded outer end 136 which aids in the even dispersement of the parallel grain structure 134 throughout the flattened transverse ends 132. The ends 22 of the cylindrical blank 24 are upset simultaneously because identically sized spacing means 68 and punches 36 are used at either end of the lower die recess 28 which are set into motion simultaneously because a single upset force initiates movement at both ends.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

We claim:

1. An extruded metal chain pin (34) for connecting center and side links of a chain together, said chain pin (34) comprising:

an extruded solid cylindrical body (130) having a predetermined diameter and defining a longitudinal axis (B), said cylindrical body (130) including two ends (132) and having an extruded grain structure (134) extending parallel to said longitudinal axis (B) from one of said ends (132) through said cylindrical body (130) to the other of said ends (132);

each of said two ends (132) including flattened transverse ends (132) having a length greater than said predetermined diameter, said extruded grain structure (134) defining flare-out points such that said extruded grain structure (134) flares out throughout said flattened transverse ends (132) at said flare-out points, said extruded metal chain pin (34) characterized by all of said extruded grain structure (134) extending parallel to said longitudinal axis (B) and into said flattened transverse ends (132) before reaching said flare-out points.

2. An extruded metal chain pin (34) as set forth in claim 1 further characterized by said flare-out points defining an imaginary convex surface (C) at each of said two flattened transverse ends (132).

3. An extruded metal chain pin (34) as set forth in claim 2 further characterized by said flattened transverse ends (132) having a substantially rectangular cross section.

* * * * *